United States Patent [19]

Jacobsson

[11] 4,106,713

[45] Aug. 15, 1978

[54] THREAD FEEDER FOR TEXTILE MACHINES

[75] Inventor: Kurt Arne Gunnar Jacobsson, Ulricehamn, Sweden

[73] Assignee: Aktiebolaget IRO, Ulricehamn, Sweden

[21] Appl. No.: 793,254

[22] Filed: May 3, 1977

[30] Foreign Application Priority Data

May 12, 1976 [DE] Fed. Rep. of Germany ..... 2621014

[51] Int. Cl.[2] ..... B65H 51/20

[52] U.S. Cl. ..... 242/47.01

[58] Field of Search ..... 242/47.01, 47.04, 47.05, 242/47.06, 47.07, 47.08, 47.09, 47.1, 47.11, 47.12, 47.13, 49; 66/132 R

[56] References Cited

U.S. PATENT DOCUMENTS

| | | | |
|---|---|---|---|
| 3,625,444 | 12/1971 | Hatay | 242/47.01 |
| 3,791,599 | 2/1974 | Jacobsson | 242/47.12 |
| 3,820,731 | 6/1974 | Rosen | 242/47.01 X |
| 3,883,083 | 5/1975 | Rosen | 242/47.01 |

*Primary Examiner*—Stanley N. Gilreath
*Attorney, Agent, or Firm*—Blanchard, Flynn, Thiel, Boutell & Tanis

[57] ABSTRACT

A thread delivery device for a textile machine having a rotatable drum on which a thread issuing from a thread bobbin can be wound tangentially for forming an intermediate thread storage. The drum has a lower thread removal edge over which the thread can be withdrawn tangentially for permitting positive thread delivery. A thread guide member is stationarily positioned radially outside of the drum approximately at the level of the removal edge to guide the withdrawn thread. A thread control element is disposed in engagement with the withdrawn thread at a location between its engagement with the drum and the thread guiding member. The thread control element, which is movable transversely relative to the withdrawal path of the thread, is positioned approximately at the level of the removal edge of the drum and is maintained in this position by its engagement with the withdrawn thread so long as the normal working tension is maintained in the thread. When the tension in the withdrawn thread decreases, then the thread control element moves transversely of the thread path, either due to its own weight or due to the urging of a spring, downwardly into a position wherein the thread control element is disposed below the plane of the removal edge to prevent the slack thread from being reversely wound on the drum.

9 Claims, 10 Drawing Figures

FIG. 7
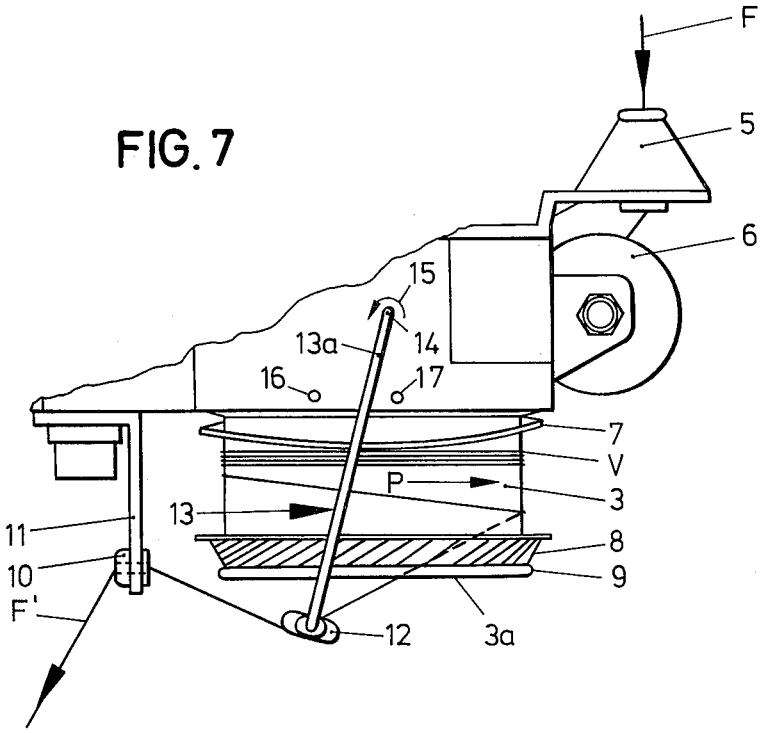
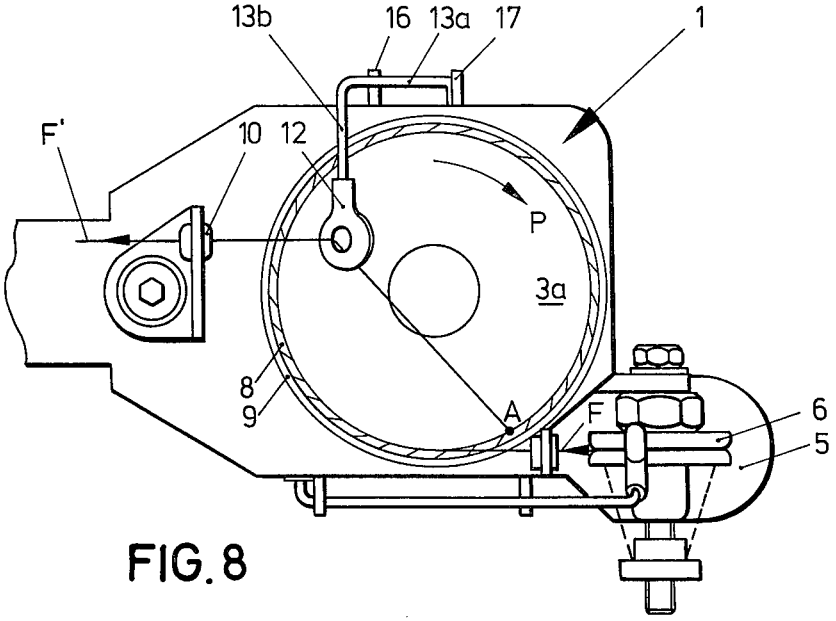
FIG. 8

THREAD FEEDER FOR TEXTILE MACHINES

BACKGROUND OF THE INVENTION

This invention relates to a drum-type thread feeder for a textile machine.

In a known thread feeder of this type (see U.S. Pat. No. 3,883,083) the thread feeder element is designed as a disc brake mounted on a pivotal arm and maintained in an opened position by a stationary brake opening element in the case of positive thread feed. The disk brake thus functionally forms a guide eye which forces the thread to unwind tangentially from the drum, thereby achieving the desired positive feed. The thread brake together with its pivotal arm is adapted to be pivoted manually even into a position below the plane of the thread drum in order to arbitrarily change the device over to intermittent thread feed. A thread control element is disposed radially outside the disc brake forming the thread feed element when seen relative to the drum and is designed as an eye mounted on a pivotal arm. The last-mentioned pivotal arm is spring-loaded and urges the eye upwardly with respect to the plane of the removal edge of the drum, thereby forming a tension compensation loop in the path of thread behind the thread feeder element. If the thread loosens, this tension compensation loop enlarges. It has been found that the loose length of the thread which can be a accommodated in the tension compensation loop in this manner, however, is not sufficient in many cases. The thread drum which continues to rotate for at least a certain time after the thread has loosened pulls the thread along with it at the site of the removal edge and winds it in the wrong direction. In addition to eliminating the original disruption, it is then also necessary to remove the incorrect yarn windings directly above the removal edge, since these would produce an excess supply as soon as the device is started again, thus resulting in another disruption.

It is already known to arrange in a thread feeder the element effecting positive thread feed in the form of an open hook on the side of the drum above the level of the removal edge (see U.S. Pat. No. 3,908,921). The problem of rewinding does not occur there, since the loosened thread is not supported at the level of the removal edge. Due to the low stationary arrangement of the thread guide element, a force component results which is directed downwardly and which acts on the unwinding thread. In the case of yarns which tend to form strong adhesion between adjacent windings due to their fluffiness or for other reasons, there is a danger due to this force component that the second respective winding will be pulled downwardly as well and excess feed will occur. Hence, a device of the type described at the outset, i.e. a thread guide element disposed at the level of the removal edge, is required for such yarns.

The object of the invention is to provide an improved thread feeder of the class described at the outset, i.e. comprising a drum adapted to be set in rotation and associated with a stationary thread guide element disposed at the level of the removal edge for positive thread feed, that such when the thread becomes loose between the textile machine and the feeder, the drum is prevented from winding back the already unwound thread in the wrong direction onto the removal edge area of the drum.

During normal operation, the thread control element is maintained by the tension of the unwinding thread in a position which permits the tangential removal by the stationary thread guide element and thus perfect positive feed. When the removal tension diminishes, the removal site on the removal edge of the thread migrates in the direction of rotation of said drum together with the drum edge. At the same time, the thread is deflected downwardly away from its removal site on the thread edge by means of the descending thread control element. The thread segment extending downwardy away from the drum edge cannot be wound by the drum which continuous to rotate even if it hangs completely loose due to the change in tension. Even if there is no removal of thread from the drum any more and the drum continuous to rotate prior to its standstill or rotates again after an interruption of operation, a thread segment which has a length corresponding to the distance between the thead control element and the most remote site of the drum edge moves similar to a crank in the area beneath the drum. When the textile machine and the drum are started again after elimination of the disruption, the thread control element causes a kind of intermittent thread feed, i.e. the textile machine can initially remove as much yarn from the drum as it requires until normal operating tension has been reached, whereby the thread control element has moved into its corresponding position and thread feed is once again positive. A special advantage of the device in accordance with the invention can be seen in the fact that a very low thread tension can be achieved by the reduction in the site of friction.

In an advantageous embodiment the thread control element is arranged to be pivotal such that it reaches below the base of the drum during its descent movement. The thread segment between the thread control element and the drum edge, which rotates during continued rotation of the drum after the reduction in tension, is thus substantially shorter than if the thread control element were lowered outside the drum. In no case can a loop be formed. In addition, an especially rapid display of disturbances is achieved in the case of this construction due to the movement of the thread control element.

A bent pivotal arm comprising a first leg of a length exceeding the drum height can be provided for the thread control element in an advantageously simple manner. The free end thereof is rotatably mounted on the housing above the drum and outside the projection of the drum periphery in such a way that the leg is movable in a plane which is adjacent the drum and approximately parallel to its longitudinal axis, and that a second leg extends from the first leg substantially toward the drum and forms or supports at its free end the thread control element. Both the pivotal arm and its mounting can be designed in this way to be very simple and economical and require only little space. The path of movement of the thread control element corresponds to a circular arc so that the movement of the thread control element or the pivotal arm can be balanced out in a simple way.

The second leg of the pivotal arm may have a length which is shorter than the distance of the plane of movement of the first pivotal arm from the drum axis. The thread segment between the rotating removal site on the drum edge and the thread control element is thus especially short during the first half rotation after the reduction in tension. If the drum comes to a rapid standstill, the thread will not be pulled back at all by the thread guide element in this way. In addition, a lateral deflection results in addition to the deflection of the thread segment in a downward direction.

In order to regulate the thread tension even during fluctuations in tension, which do not cause complete loosening of the thread, the spring advantageously has such a progressive characteristic that in every position of the pivotal arm the force component urging the thread control element downwardly is substantially equal, i.e. the spring force compensates for the weight components which vary in the different positions of the pivotal arm.

As is the case in all thread feeders, a shut-off means which stops the textile machine and the feeder in the case of disruption, is also required on the device according to the invention. It can be designed and arranged in the known manner. The thread control element, however, can be designed as a shut-off means as well in an especially advantageous manner as is known per se from U.S. Pat. No. 3,883,083. The shut-off function, however, can be arbitrarily deactivated temporarily when the shut-off eye is positioned below the base surface of the drum, thereby restarting the device even if the thread control element is in the shut-off position. This then moves automatically into the operating position again as the tension increases.

BRIEF DESCRIPTION OF THE DRAWINGS

FIG. 7 is a fragmentary side elevational view showing still yet another mode of operation, FIG. 8 is a bottom view corresponding to the position of FIG. 7.

DETAILED DESCRIPTION

Figure 1:
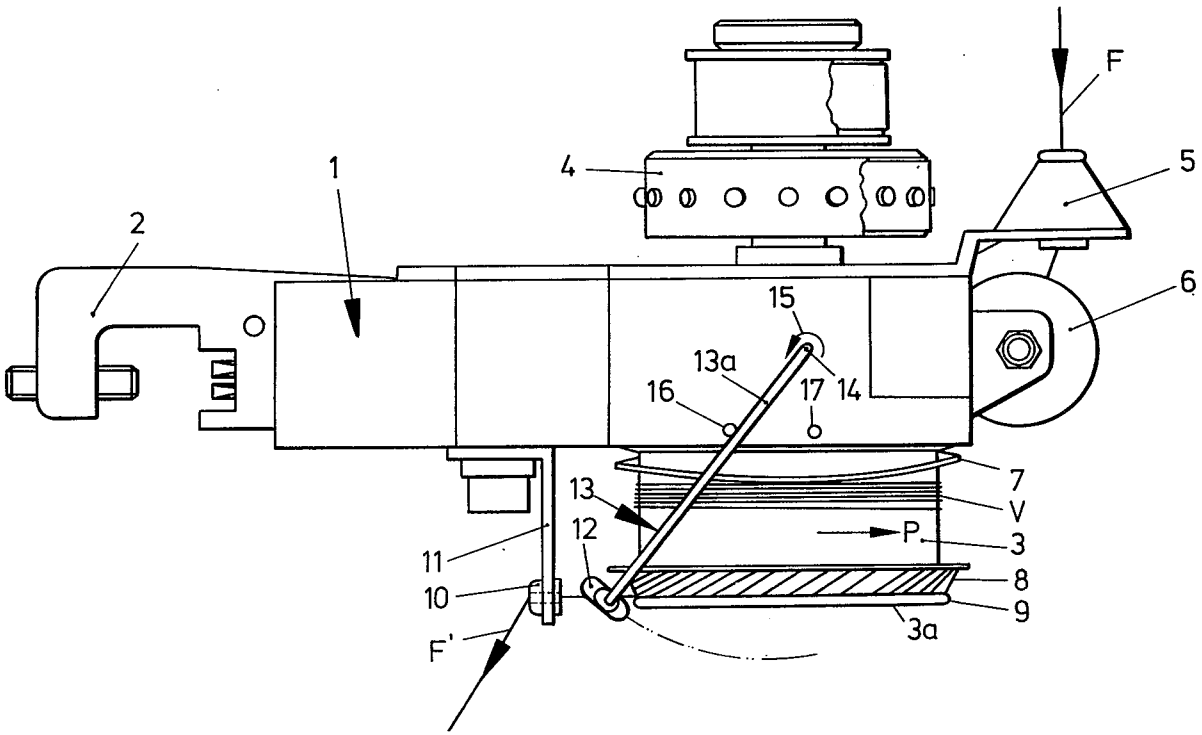
FIG. 1 is a schematic side elevational view of a thread feeder in the normal mode of operation.

The thread feeder illustrated in FIG. 1 includes a housing 1 which is adapted to be secured to a textile machine by means of a fastening means 2. A plurality of such feeders is provided for textile machines, for example knitting machines. A drum 3 is rotatably journalled in the housing 1 so as to move in the direction of the arrow P and which is driven by a pin wheel 4 by means of a perforated belt (not shown) which is driven synchronously with the textile machine. A thread F issues from a supply bobbin (not shown), passes through a thread guide 5 and a disc brake 6 and is wound tangentially on the rotating drum. The drum 3 is associated with a thread displacing disc 7 which advances the forming thread windings in the axial direction of the drum so that a thread reservoir V is formed thereon. The thread is withdrawn tangentially from this reservoir through a brake ring 8 with elastic fingers over a lower removal edge 9 of the drum 3 for positive thread feed through a thread guide element 10 designed as a closed stationary eye. From said stationary eye 10, the unwinding thread F′ then arrives at the working location of the textile machine. The eye 10 is secured to the housing 1 by means of a support arm 11.

Figure 2:
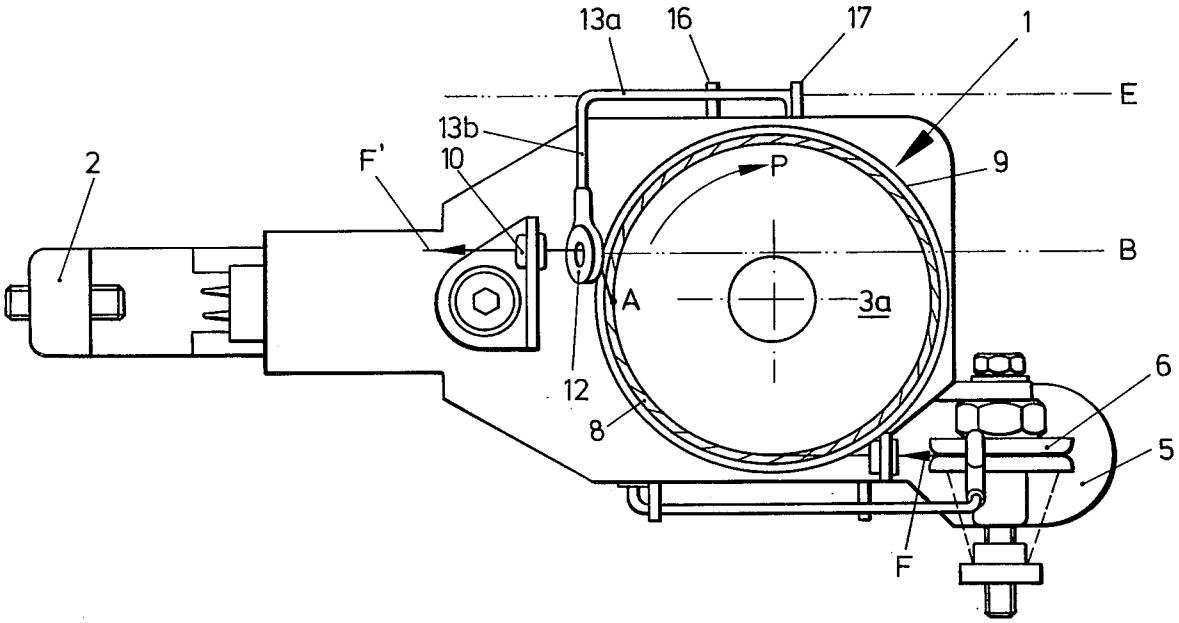
FIG. 2 is a schematic bottom view of the device according to FIG. 1.

The unwinding thread F′ passes through a movable thread control element 12 in the form of a ring positioned between the removal edge 9 of the drum 3 and the stationary closed eye 10. This ring is disposed on a bent pivotal arm 13. The pivotal arm 13 has a first leg **13*a* which has one end pivotally mounted in a bearing 14 on the housing 1 such that it can be pivoted in a plane E which is adjacent the drum and approx. parallel to its longitudinal axis. The second leg 13*b* is connected to the other end of the first leg 13*a*, forms a right angle and is perpendicular to the plane E, and points towards the drum. The ring 12 is secured to the free end of the second leg 13*b*. The leg 13*a* is dimentioned such that it exceeds not only the perpendicular distance of the bearing 14 from the drum base 3*a*, but also that the second leg 13*b* with the ring 12 can move from a position below the drum base 3*a* into the operating position adjacent the removal edge illustrated in FIG. 1 even during a pivotal movement without coming into contact with this edge. The second leg 13*b* has a length which is shorter than the distance of the plane of movement E of the first leg from the drum axis so that the ring 12 does not move below a diameter of the drum, but rathr moves in a plane which is between a diameter of the drum and the drum edge. The projection of the pass of movement of the ring is indicated in FIG. 2 by a dash-dot-dot line designated as B. The bearing 14 is associated with a torsion spring which is illustrated in FIG. 1 merely by an arrow 15 indicating its direction of movement. The torsion spring has such a progressive characteristic that it produces on the ring the same force component contrary to the thread tension in every position of the pivotal arm 13 independent of the varying weight component thereof. The operating position of the pivotal arm 13 illustrated in FIG. 1** is effected by the removal tension of the unwinding thread F′ which pulls the ring into the position illustrated.

FIG. 2 is a schematic elevation of the device from below. The removal site A for the unwinding thread F′ is marked on the removal edge 9 and remains stationary relative to the housing or to the stationary eye 10 during normal operation, i.e. it migrates relative to the rotating drum.

OPERATION

The mode of function of the illustrated device is as follows: The thread F′ leaving the feeder is removed due to a specific operating tension by the textile machine. The stationary thread control element disposed radially of the drum in the form of the eye 10 causes the tangential removal from the rotating drum 3 so that the drum always supplies as much thread as is wound simultaneously thereon in order to supplement the thread reservoir. As already mentioned above, the operating tension of the thread pulls the ring 12 against the force of the torsion spring into the position adjacent the drum and approximately at the level of the removal edge so that it permits tangential thread removal. Any other movement of the ring 12 in an upward direction, for example when greater thread tension occurs, is prevented by a stop 16 on the housing which limits the pivotal movement of the first leg 13*a*.

Figure 3:
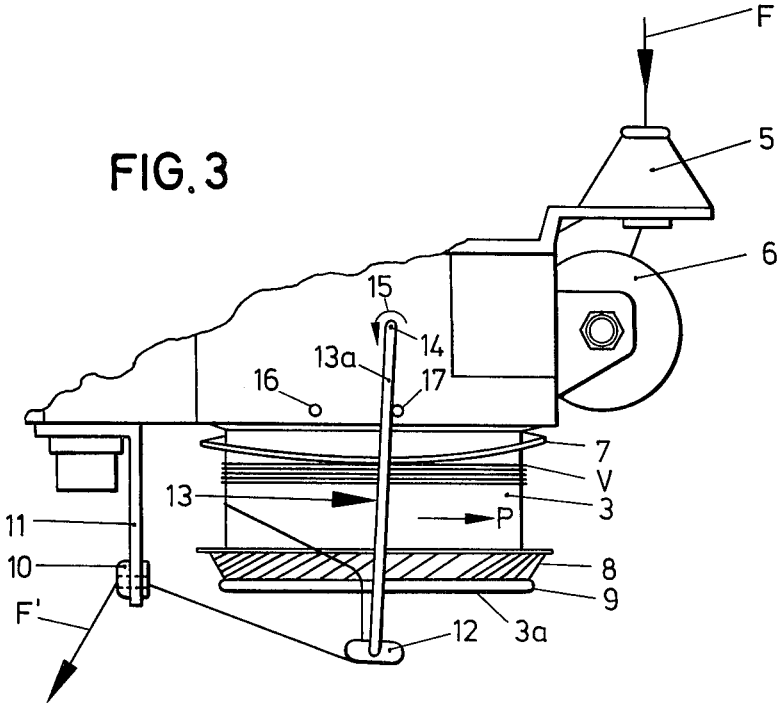
FIG. 3 is a fragmentary side elevational view showing the drum area of the device in another mode of operation.
Figure 4:
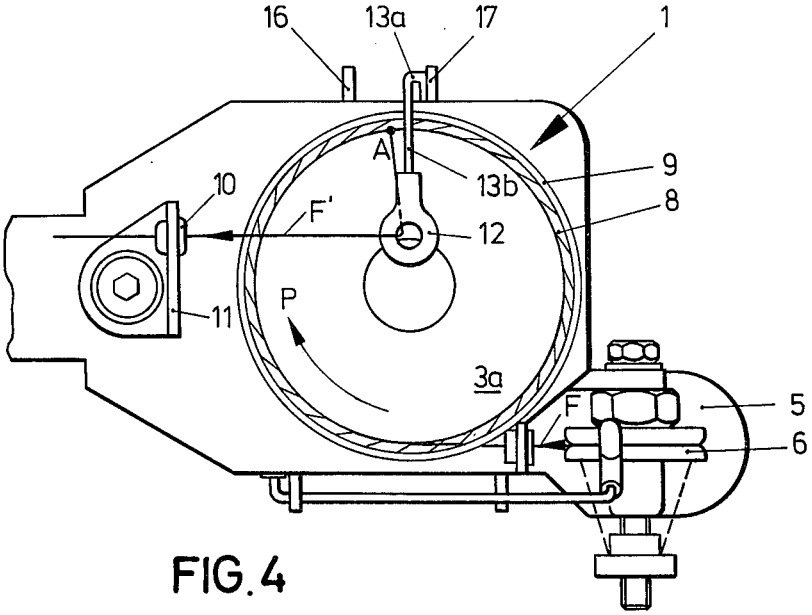
FIG. 4 is a bottom view corresponding to the position of FIG. 3.
Figure 5:
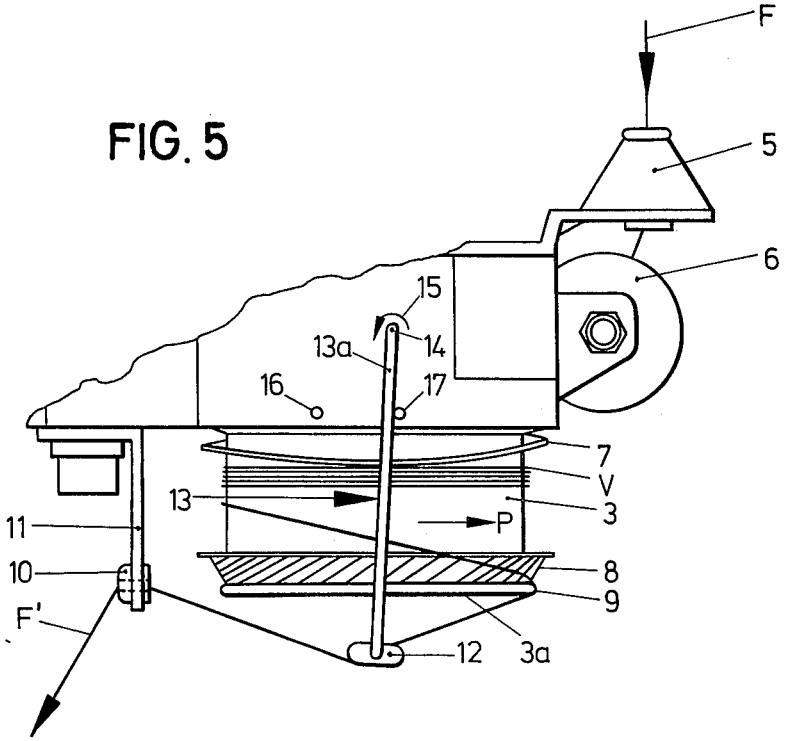
FIG. 5 is a fragment side elevation view showing the drum area in yet another mode of operation.
Figure 6:
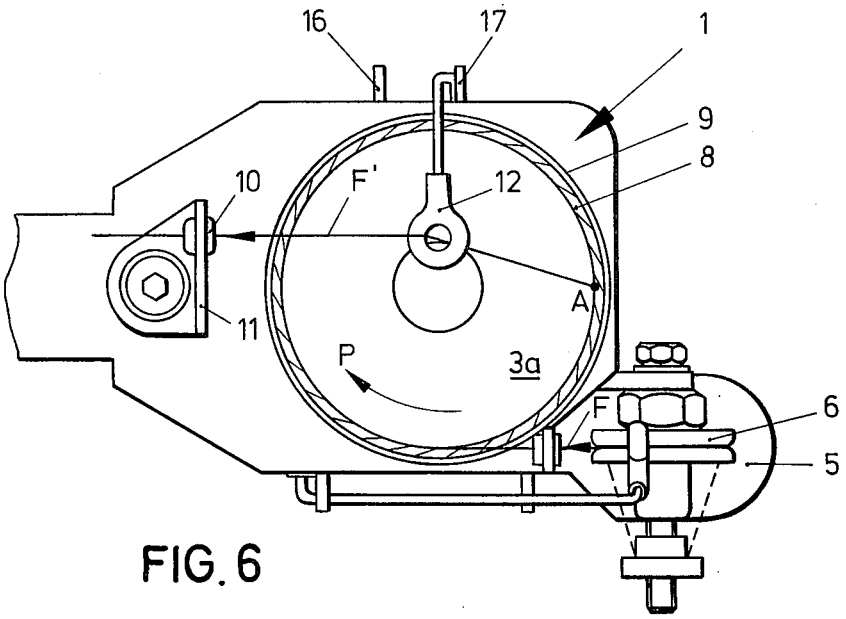
FIG. 6 is a bottom view corresponding to the position of FIG. 5.

As soon as the thread tension between the textile machine and the stationry eye 10 diminishes due to a disruption, a backup of thread, or the like, the force component acting on the ring due to the torsion spring is predominant and the ring is moved downwardly. In this way, it initially extends the path of the thread between the removal site A and the stationary eye 10. In addition, it immediately forces the unwinding thread F' to no longer leave the removal edge in a tangential direction, but rather in a downward direction. When the removal tension drops off rapidly, the thread is no longer pulled through below the fingers of the brake ring, but is supported by the brake ring, i.e. the thread remains at the same site on the brake ring or removal edge and is pulled along by the drum which continues to rotate, while the ring 12 moves into the lower position shown in FIG. 3 with the leg 13*a* being almost perpendicular. In so doing, the leg 13*a* abuts against a stop 17 which limits the movement in this direction. Moreover, a shut-off means (not shown) disposed in the pivot bearing 14 for deactuating the machine and the drum is actuated in this position. FIGS. 3 and 4 indicate the directions of the thread F' between the site A which has migrated about one-quarter of a circle on the removal edge 9, the ring 12, and the stationary eye 10. The ring 12 forces the thread to stretch over the removal edge 9 in a downward and inclined position below the drum base and has pulled a portion of the slack thread through the eye 10 while moving into this position. As the drum continuous to rotate out of this position, site A arrives at the position which is shown in FIGS. 5 and 6, since the distance between site A and ring 12 increases in so doing, and increases even more as the drum continuous to rotate past the position according to FIG. 6, part of the slack thread is also pulled through the ring 12 towards site A, but in no case is it pulled over the removal edge.

The switch-off means associated with the bearing 14 is designed such that it can be rendered ineffective by hand, even if the thread control element is still located in the switch-off position. It is thus possible to restart the machine and the drum. FIGS. 7 and 8 show the situation as the drum begins to rotate again. Point A has moved further in the direction of drum rotation. The again increasing removal tension on the thread F' has already began to pivot the ring 12 into the operating position again. It is still located, however, under the base 3*a* of the drum. Hence, the thread F' is initially pulled downwardly by the drum so that something similar to intermittent thread feed occurs, i.e. the machine can take up as much thread as it requires until the ring 12 is again located in the operating position shown in FIG. 1 when normal thread tension is attained, thus again effecting positive thread feed.

Even if the drum continues to rotate through a long distance or a multiple thereof after being shut down or if it executes several rotations after being started again before the operating tension has built up again, the thread control element, which has been lowered below the level of the drum base, prevents the thread leaving the removal edge 9 at site A from being drawn up again or even wound. The thread segment extending from site A to the thread control element merely rotates beneath the drum in a fashion similar to a crank. Although it occasionally becomes looser, it does not become entangled anywhere.

Figure 10:
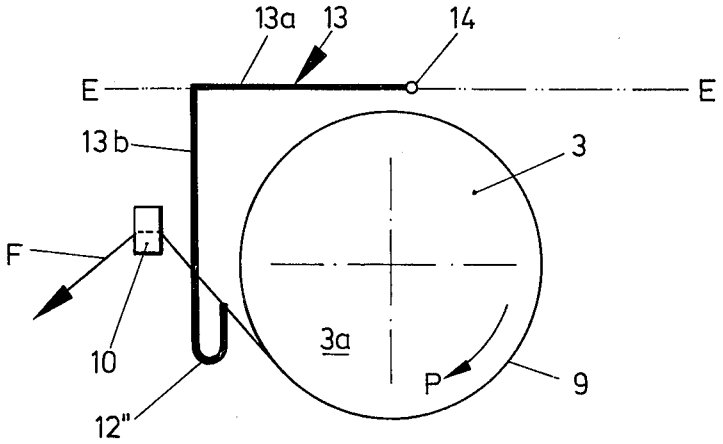
FIG. 10 is a schematic bottom view of yet another embodiment.
Figure 9:
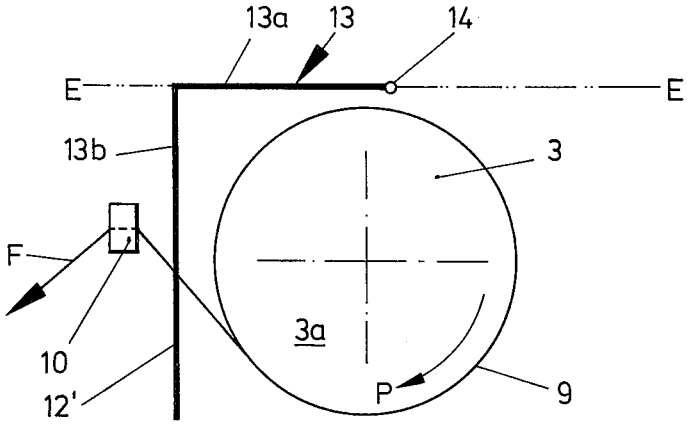
FIG. 9 is a schematic bottom view of another embodiment.

FIGS. 9 and 10 show schematic bottom views of other embodiments, each in the normal operating position, i.e. corresponding to FIG. 2. The difference is to be found in the design of the thread control element 12. In FIG. 9 the thread control element 12' is so to speak an extension of the second leg 13*b* and is integral therewith. The leg 13*b* thus has a length which corresponds at least to the drum diameter + the distance of the drum from the plane E. The leg 13*b* is located on the upper side of the thread segment between the drum 3 and the eye 10 and urges the thread downwardly during its descending movement. The length ensures that the thread cannot slip off the thread control element 12' during this movement or during the movement of the removal site A.

FIG. 10 shows a thread control element 12'' which is bent to form an open hook on the leg 13*b*. The mode of function of this design is the same as explained in FIGS. 1 to 8.

The invention is not limited to the embodiments. Both the thread control element 12 as well as the thread guide element 10 may be designed as open eyes within the scope of the invention. Moreover, the thread control element may also be disposed approximately parallel to the drum axis to permit upward and downward movement in such a manner that it descends outside the drum base below the level thereof as the tension drops. The only important point is that the descent be so far in a downward direction that the thread F' is reliably held down in every position of the site A as it continues to move. A progressive balance for this descending movement, e.g. by means of a spring, is also desirable.

The pivotal arm can also be balanced by its own weight instead of a spring.

The angular position of the two pivotal arm legs to one another as shown in the embodiment is especially space-saving and advantageous with respect to the plane of movement. It is also possible, however, to arrange the second leg which supports the guide eye at another, preferably obtuse angle with respect to the first leg and also at another angle with respect to the pivotal plane as long as the mobility of the guide eye below and adjacent the removal edge is guaranteed.

What I claim is:

1. In a thread delivery device for a textile machine having a drum which can be set in rotation and on which a thread issuing from a thread bobbin can be wound tangentially for forming an intermediate thread storage, said drum having a thread removal edge over which the thread can be withdrawn tangentially from the drum for permitting positive thread delivery, a thread guiding member stationarily positioned radially outside of the drum approximately at the level of the removal edge, said thread guiding member being engaged with the thread as withdrawn tangentially from the drum over the removal edge thereof, and a thread control element disposed for engagement with the withdrawn thread at a location disposed between its engagement with the drum and the thread guiding member, the thread control element being engaged with the withdrawn thread and positioned approximately at the level of the removal edge of the drum during withdrawal of the thread from the drum when the thread is subjected to a normal operating tension, comprising the improvement wherein the thread control element is disposed in the path of the withdrawn thread as it extends radially outwardly from the drum to the stationary thread guiding member, said thread control element being mounted for movement transversely of said path and transversely relative to the removal edge of said drum, and means for urging the thread control element and the withdrawn thread engaged therewith to move transversely of said path toward a position disposed below the plane of the removal edge when the tension in the withdrawn thread falls below said normal operating tension.

2. A device according to claim 1, wherein the urging means for the thread control element comprises either its own weight or a spring which causes the thread control element to move below the plane of said removal edge when the tension in the withdrawn thread falls below said normal operating tension.

3. A device according to claim 2, wherein the thread control element is pivotally mounted for swinging movement in a direction transverse to said path such that the thread control element is swingably lowered into a position below the removal edge.

4. A device according to claim 2, wherein the thread control element is pivotally mounted for swinging movement into a lowermost position wherein it is disposed directly below the drum and is positioned within an imaginary cylindrical surface which constitutes a downward axial extension of the outer periphery of said drum.

5. A device according to claim 2, wherein the thread control element is mounted on a swingable L-shaped lever having a first leg with a length greater than the drum height, said first leg having the free end thereof pivotally supported on a housing positioned above the drum and defining a pivot axis which extends transversely with respect to a plane which contains the rotational axis of said drum, said first leg extending downwardly along the outside of said drum, said L-shaped lever having a second leg which is transverse to and connected to the lower end of said first leg, said second leg extending inwardly toward the drum and having the thread control element associated with the free end thereof.

6. A device according to claim 5, wherein the L-shaped lever is pivotal about an axis which is perpendicular to the rotational axis of said drum, said first leg being positioned and swingable within a plane which is adjacent to and spaced outwardly from the periphery of said drum and is substantially parallel to the rotational axis thereof, said second leg being substantially perpendicular to said first leg and perpendicular to said last-mentioned plane, said thread control element being positioned below said drum within the projection of the drum circumference when said lever is swung downwardly to position said thread control element in its lowermost position.

7. A device according to claim 6, wherein said second leg has a length which is less than the perpendicular distance between said last-mentioned plane and said rotational axis.

8. A device according to claim 2, wherein said thread control element comprises an eyelet.

9. In a thread delivery device for a textile machine having a drum rotatable about its longitudinal axis and on which a thread issuing from a thread storage can be wound tangentially for forming an intermediate thread supply, said drum having a thread removal edge adjacent one axial end thereof over which the thread can be withdrawn tangentially from the drum at a normal working tension for permitting positive thread delivery to a textile machine, a thread guiding member stationarily positioned radially outside of the drum approximately at the level of the removal edge and being engaged with the thread as withdrawn tangentially from the drum over said removal edge, and a thread control element disposed for engagement with the withdrawn thread at a location disposed between its engagement with the drum and the thread guiding member, comprising the improvement wherein the thread control element is normally maintained in a position approximately at the level of the removal edge of the drum and is disposed within the path of the withdrawn thread as it extends radially outwardly from the drum to the stationary thread guiding member, said thread control element being maintained in said position in engagement with the withdrawn thread so long as the thread is subjected to said normal operating tension, said thread control element being mounted for movement transversely of said path, and means for urging the thread control element and the withdrawn thread engaged therewith to move transversely of said path away from said position toward a location disposed axially outwardly from said one end of the drum when the tension in the withdrawn thread falls below said normal operating tension, whereby the withdrawn thread is deflected axially away from the removal edge.

* * * * *